US011041308B2

(12) United States Patent
Thornton

(10) Patent No.: US 11,041,308 B2
(45) Date of Patent: Jun. 22, 2021

(54) STRUCTURAL MEMBER HAVING PAIRED FLANGES AND WEB

(71) Applicant: Andrew Thornton, Oaks Flats (AU)

(72) Inventor: Andrew Thornton, Oaks Flats (AU)

( * ) Notice: Subject to any disclaimer, the term of this patent is extended or adjusted under 35 U.S.C. 154(b) by 0 days.

(21) Appl. No.: 16/085,805

(22) PCT Filed: Mar. 9, 2017

(86) PCT No.: PCT/AU2017/050212
§ 371 (c)(1),
(2) Date: Sep. 17, 2018

(87) PCT Pub. No.: WO2017/156573
PCT Pub. Date: Sep. 21, 2017

(65) Prior Publication Data

US 2019/0100918 A1 Apr. 4, 2019

(30) Foreign Application Priority Data

Mar. 15, 2016 (AU) ..... 2016900952
Mar. 16, 2016 (AU) ..... 2016900987
(Continued)

(51) Int. Cl.
*E04C 3/04* (2006.01)
*E04C 3/06* (2006.01)
(Continued)

(52) U.S. Cl.
CPC ..... *E04C 3/06* (2013.01); *E04C 3/14* (2013.01); *E04C 3/28* (2013.01); *E04C 3/29* (2013.01);
(Continued)

(58) Field of Classification Search
CPC ..... E04C 3/06; E04C 3/14; E04C 3/29; E04C 3/292; E04C 3/42; E04C 2003/0413; E04C 2003/0452; E04C 2003/0447; E04B 2/708
(Continued)

(56) References Cited

U.S. PATENT DOCUMENTS 96,793 A * 11/1869 Gatling ..... E04C 3/292 52/376
426,558 A * 4/1890 Dithridge ..... E04C 3/06 52/843
(Continued)

FOREIGN PATENT DOCUMENTS

CN 103015626 A 4/2013
DE 202014002499 U1 * 5/2014 ..... E04C 3/08
(Continued)

OTHER PUBLICATIONS

International Search Report dated Apr. 18, 2017, for corresponding International Patent Application PCT/AU2017/050212 filed on Mar. 9, 2017.
(Continued)

*Primary Examiner* — Robert Canfield
(74) *Attorney, Agent, or Firm* — David D. Brush; Westman, Champlin & Koehler, P.A.

(57) ABSTRACT

A structural member comprising a first round flange, a second round flange substantially parallel to the first round flange, an elongate web disposed between the first and second round flange, the web having an upper edge, and a lower edge, wherein the first round flange, the second round flange and the elongate web are secured together to form a structurally integral unit. The structural member may further comprise a third round flange and a fourth round flange substantially parallel to the third round flange, wherein the round flanges and the elongate web are secured together to
(Continued)

form a structurally integral unit in which the first face of the web is in contact with the first round flange and the third round flange, and the second face of the web is in contact with the second round flange and the fourth round flange.

14 Claims, 7 Drawing Sheets

(30) Foreign Application Priority Data

Apr. 29, 2016 (AU) ..... 2016901587
Jun. 23, 2016 (AU) ..... 2016902472

(51) Int. Cl.
*E04C 3/14* (2006.01)
*E04C 3/28* (2006.01)
*E04C 3/292* (2006.01)
*E04C 3/29* (2006.01)

(52) U.S. Cl.
CPC ..... *E04C 3/292* (2013.01); *E04C 2003/0413* (2013.01); *E04C 2003/0452* (2013.01)

(58) Field of Classification Search
USPC ..... 52/233, 836, 837, 838, 841, 847, 690, 52/696
See application file for complete search history.

(56) References Cited

U.S. PATENT DOCUMENTS 1,645,060 A * 10/1927 Kraft ..... E04C 3/09 52/634
1,646,974 A * 10/1927 Moyer ..... B23K 11/008 219/58
1,651,032 A * 11/1927 Macomber ..... E04C 3/08 52/691
1,680,976 A * 8/1928 Field ..... E04C 3/08 52/634
1,705,708 A * 3/1929 Beisel ..... E04C 3/08 52/693
1,740,053 A * 12/1929 Wehr ..... E04C 3/06 52/839
1,782,349 A * 11/1930 Hull ..... D21G 3/00 52/847
1,953,460 A * 4/1934 Bernhard ..... E04B 2/708 52/233
2,289,018 A * 7/1942 Jonsrud ..... E04B 2/703 52/233
2,418,929 A * 4/1947 Glassbrook ..... E04C 3/07 403/389
3,079,649 A * 3/1963 Willatts ..... E04C 3/14 52/841
4,012,876 A * 3/1977 Grubbs ..... E04B 2/708 52/233
4,305,238 A * 12/1981 Harward ..... E04B 2/702 428/17
4,677,806 A 7/1987 Tuomi
5,079,894 A * 1/1992 Lau ..... E04C 3/14 52/847
6,497,080 B1 * 12/2002 Malcolm ..... E04C 3/14 52/474
7,434,366 B2 10/2008 Zahner, III
8,910,454 B2 * 12/2014 Thornton ..... E04C 3/292 52/837
9,038,347 B2 * 5/2015 Gundersen ..... E04B 1/30 52/636
9,499,983 B2 * 11/2016 Gundersen ..... E04B 1/30
2005/0017232 A1 * 1/2005 Chen ..... E04F 11/181 256/59
2005/0108979 A1 * 5/2005 Yttrup ..... E04C 3/07 52/837
2005/0108980 A1 5/2005 Barkmakian
2009/0293373 A1 * 12/2009 Klinkhamer ..... E04B 2/705 52/79.9
2011/0016824 A1 1/2011 Thornton et al.
2015/0135638 A1 5/2015 Yang
2020/0001190 A1 * 1/2020 Stelzl ..... A63G 7/00

FOREIGN PATENT DOCUMENTS

EP 1180421 A2 * 2/2002 ..... E04C 3/29
FR 2596471 A2 10/1987
SU 947346 A1 7/1982
SU 1761476 A1 * 9/1992
WO WO-0192655 A1 * 12/2001 ..... E04C 3/06
WO 2010057243 A1 5/2010
WO WO-2016086275 A1 * 6/2016

OTHER PUBLICATIONS

Written Opinion of the International Searching Authority dated Apr. 18, 2017, for corresponding International Patent Application PCT/AU2017/050212 filed on Mar. 9, 2017.

* cited by examiner

STRUCTURAL MEMBER HAVING PAIRED FLANGES AND WEB

BACKGROUND TO THE INVENTION

I-beams are known in civil engineering and construction applications as being an efficient form for carrying both bending and shear loads in the plane of the web. I-beams are often used as major support trusses in buildings, reducing the need for pillars, and allow the creation of broad open spaces within buildings.

While undoubtedly useful, prior art I-beams are well known to be inefficient in carrying torsion. Accordingly, in applications where torsional forces may be significant and I-beam must be significantly over engineered or an alternative support structure must be used. This problem is related to the basic profile of an I-beam and is therefore applicable irrespective of the material from which the beam is formed.

I-beams are typically fabricated from steel, but may be made from wood in which case the term "I-joist" may be used. Timber is preferred in some applications for its strength for load bearing and its natural ability to withstand a variety of forces. Additionally, compared to metal based materials, timber structural members often cost less to manufacture and are more easily cut and processed for specific building requirements. A problem of particular to wooden I-beams is the cost of laminating the portions together to create the beam. Furthermore, relatively large diameter lumber is required. Any imperfection in the flange can greatly compromise the strength of the flange, so relatively high quality lumber is required for the manufacture of timber joists. This has led in turn to increased cost in production as well as raising natural resource conservation issues. Depending on the part of the log it is sawn from, the solid lumber may have issues with natural defects such as splinters, rot, abnormal growth and grain structures. Additionally, when sawn and prepared for commercial use the lumbers are prone to processing defects such as chipping, torn grain and timber wanes.

To address the problems associated with solid wood lumber, alternative forms of wood material for making timber joists have been sought. These include engineered wood composites such as plywood, laminated veneer lumber ("LVL"), oriented strand lumber ("OSL") and oriented strand board ("OSB"). Wood composites have the advantage of being less expensive in raw material cost (as they are able to be formed from lower grade wood or even wood wastes) and do not have the problems associated with solid lumber defects. However, the energy and resource requirements in their manufacture are generally significantly higher as processed structural timber requires significantly more cutting, bonding, and curing than naturally formed timber. Also, timber joists made from wood composites do not have effective end grain connection and when used in building construction they are usually joined by bearing onto another member and nailed to deter sideway twisting and/or movement. This type of connection often requires further mounted metal braces which become design hindrances. Additionally, the metal braces are prone to oxidation and collapse in fire as the metal heats more readily than the timber, resulting in charring of the adjoining timber and loss of support.

It is an aspect of the present invention to provide a structural member made from steel, timber or other materials that overcomes any problem of the prior art. It is another aspect to provide an alternative to a timber structural member of the prior art.

The discussion of documents, acts, materials, devices, articles and the like is included in this specification solely for the purpose of providing a context for the present invention. It is not suggested or represented that any or all of these matters formed part of the prior art base or were common general knowledge in the field relevant to the present invention as it existed before the priority date of each claim of this application.

SUMMARY OF THE INVENTION

In a first aspect, but not necessarily the broadest aspect, the present invention provides a structural member comprising: a first round flange having a first surface extending longitudinally along the length thereof, a second round flange substantially parallel to the first round flange, the second round flange having a second surface extending longitudinally along the length thereof, an elongate web disposed between the first and second round flange, the web having: a first face configured to contact the first surface, a second face configured to contact the second surface, an upper edge, and a lower edge, wherein the first round flange, the second round flange and the elongate web are secured together to form a structurally integral unit in which at least part of the first face of the web is in contact with at least part of the first surface of the first round flange, and at least part of the second face of the web is in contact with at least part of the second surface of the second round flange.

In one embodiment of the first aspect, (i) the region of contact between the first face of the web and the first surface of the first round flange is distal to the lower edge of the web, and (ii) the region of contact between the second face of the web and the second surface of the second round flange is distal to the lower edge of the web.

In one embodiment of the first aspect, each of the first surface, second surface, first face and second face are substantially planar.

In one embodiment of the first aspect, the diameter of the first round flange is substantially the same as that of the second round flange.

In one embodiment of the first aspect, wherein the lowermost points of the first and second round flanges are substantially level.

In one embodiment of the first aspect, the lower edge of the web does not extend beyond the lowermost points of the first and second round flanges.

In one embodiment of the first aspect, wherein the uppermost points of the first and second round flanges are substantially level.

In one embodiment of the first aspect, the upper edge of the web extends beyond the uppermost points of the first and second round flanges In one embodiment of the first aspect, the structural member comprises a third round flange having a longitudinally extending slot formed therein, the slot being dimensioned so as to receive a region about upper edge of the web.

In one embodiment of the first aspect, the slot extends substantially radially into the third round flange.

In one embodiment of the first aspect, the first, second and third round flanges are substantially parallel.

In one embodiment of the first aspect, the third round flange does not contact the first or second round flange.

In one embodiment of the first aspect, the structural member comprises a third round flange having a third surface extending longitudinally along the length thereof, and a fourth round flange substantially parallel to the third round flange, the fourth round flange having a fourth surface extending longitudinally along the length thereof, wherein the first round flange, the second round flange and the elongate web are secured together to form a structurally integral unit in which at least part of the first face of the web is in contact with at least part of the first surface of the first round flange, and at least part of the second face of the web is in contact with at least part of the second surface of the second round flange, at least part of the first face of the web is in contact with at least part of the third surface of the third round flange, and at least part of the second face of the web is in contact with at least part of the fourth surface of the fourth round flange.

In one embodiment of the first aspect, (i) the region of contact between the third face of the web and the first surface of the first round flange is distal to the upper edge of the web, and (ii) the region of contact between the second face of the web and the second surface of the second round flange is distal to the upper edge of the web.

In one embodiment of the first aspect, each of the third surface, fourth surface, first face and second face are substantially planar.

In one embodiment of the first aspect, the diameter of the third round flange is substantially the same as that of the fourth round flange.

In one embodiment of the first aspect, the diameters of the first, second, third and fourth round flanges are substantially the same.

In one embodiment of the first aspect, the uppermost points of the third and fourth round flanges are substantially level.

In one embodiment of the first aspect, the upper edge of the web does not extend beyond the uppermost points of the third and fourth round flanges.

In one embodiment of the first aspect, the lowermost points of the third and fourth round flanges are substantially level.

In one embodiment of the first aspect, the third round flange overlies but does not contact the first round flange, and the fourth round flange overlies but does not contact the second round flange In one embodiment of the first aspect, the third and fourth round flanges are substantially parallel.

In one embodiment of the first aspect, the first, second, third and fourth round flanges are substantially parallel.

In one embodiment of the first aspect, the structural member comprises one or more fasteners extending through (i) (in sequence) the first round flange, the web, and the second round flange, and/or (ii) (in sequence) the third round flange, the web and the fourth round flange.

In one embodiment of the first aspect, (in plan view), one of the one or more fasteners extends substantially orthogonal to the longitudinal axis of the web.

In one embodiment of the first aspect, the structural member comprises two or more fasteners wherein, (in plan view) one of the fasteners extends at an acute angle and the other of the fasteners extends at an obtuse angle to the longitudinal axis of the web.

In one embodiment of the first aspect, the structural member comprises (in sequence) a first fastener extending (in plan view) substantially orthogonal to the longitudinal axis of the web, a second fastener extending (in plan view) at an acute angle to the longitudinal axis of the web, a third fastener extending (in plan view) at an obtuse angle to the longitudinal axis of the web, and a fourth fastener extending (in plan view) substantially orthogonal to the longitudinal axis of the web.

In one embodiment of the first aspect, at least one flange is composed of a wood, a polymer, a metal, or a fiberglass.

In one embodiment of the first aspect, at least one flange is solid.

In one embodiment of the first aspect, at least one flange is a timber pole or a timber round or a peeler core.

In one embodiment of the first aspect, the web is fabricated from a timber, or a composite timber product, or an engineered timber product.

In one embodiment of the first aspect, the web is fabricated from a non-timber product including a metal, a polymer, or a fiberglass.

In one embodiment of the first aspect, the structural member have a cross-sectional profile which is substantially symmetrical.

In one embodiment of the first aspect, the web and the round flanges are secured together by an adhesive disposed: (i) about an adjacent surface and face, and/or (ii) about a fastener (where present).

DETAILED DESCRIPTION OF THE INVENTION

Figure 1:
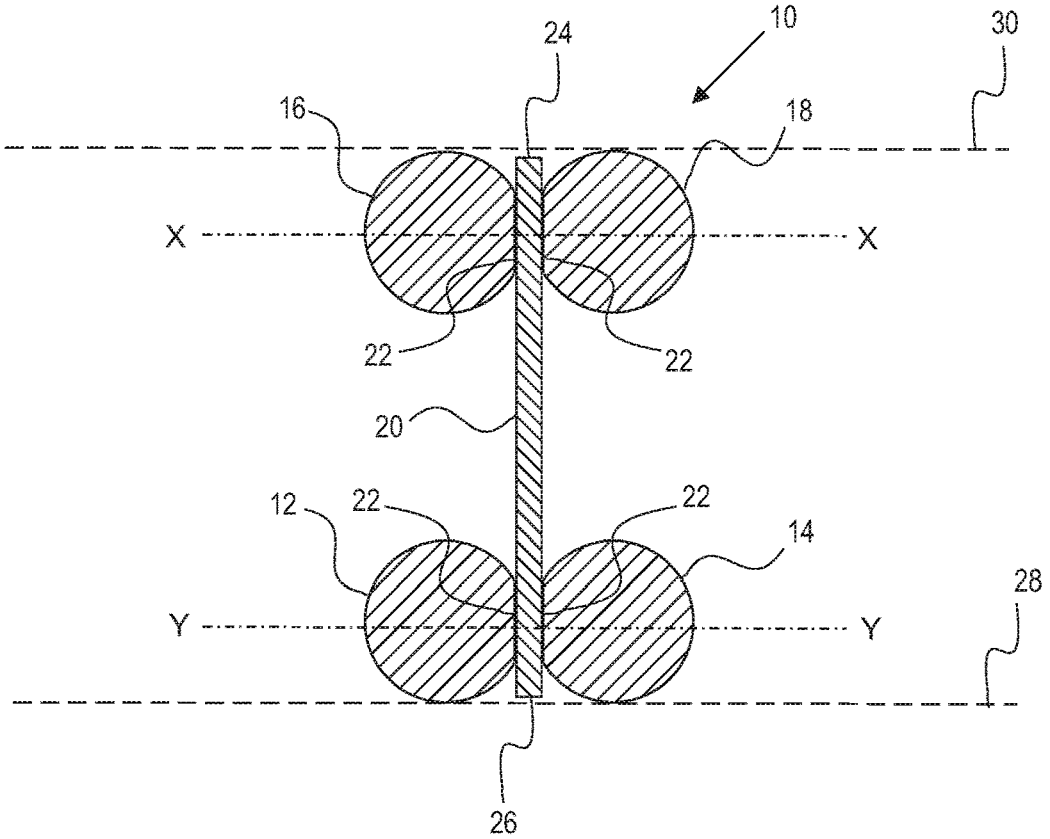
FIG. 1 is a diagrammatic representation in end view of a preferred structural member of the present invention.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Similarly it should be appreciated that the description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and from different embodiments, as would be understood by those in the art.

It is not asserted than all embodiments of the invention described herein have all advantages described herein. Some embodiments may have only a single advantage, while other embodiments may have no advantage and are merely a useful alternative to the prior art.

In the claims below and the description herein, any one of the terms "comprising", "comprised of" or "which comprises" is an open term that means including at least the elements/features that follow, but not excluding others. Thus, the term comprising, when used in the claims, should not be interpreted as being limitative to the means or elements or steps listed thereafter. For example, the scope of the expression a method comprising step A and step B should not be limited to methods consisting only of methods A and B. Any one of the terms "including" or "which includes" or "that includes" as used herein is also an open term that also means including at least the elements/features that follow the term, but not excluding others. Thus, "including" is synonymous with and means "comprising".

The present invention is predicated at least in part on the finding that flanges of round cross-section can be secured to a web to form an advantageous or an alternative structural member useful in building construction and other civil engineering applications. Accordingly, in a first aspect, the present invention provides a structural member comprising: a first round flange having a first surface extending longitudinally along the length thereof, a second round flange substantially parallel to the first round flange, the second round flange having a second surface extending longitudinally along the length thereof, an elongate web disposed between the first and second round flange, the web having: a first face configured to contact the first surface, a second face configured to contact the second surface, an upper edge, and a lower edge, wherein the first round flange, the second round flange and the elongate web are secured together to form a structurally integral unit in which at least part of the first face of the web is in contact with at least part of the first surface of the first round flange, and at least part of the second face of the web is in contact with at least part of the second surface of the second round flange.

The present structural member is an alternative to prior art I-beams based on a substantially circular cross sectional shaped pair of opposing flanges, and laminating one chamfered surface of each opposing flange along the sides and lengths of the web.

In some embodiments there is no top compression member to deform but only two opposing members to stabilise any torsional forces attempting to deform the web. In the absence of a top compression member and a bottom tension the present structural member stabilises the top compression area and also the bottom tension stabilizing area without the need for extra further lateral support (such as the need for blocking between floor joists).

Unlike prior art I Beams (which utilise top and bottom one piece flanges with three laminated surfaces for each flange) the present structural member utilizes two circular cross sectional area flanges toward the lower edge of the web (and in some embodiments also toward the upper edge of the web), each flange laminated along their longitudinal chamfers along the length of the web and each being geometrically opposite and only attached to the side faces of the web (as distinct from being attached to an upper or lower edge of a web).

As used herein the terms "upper" and "lower" are used so as to describe the relative dispositions of various components of the structural member. In particular, the terms are used in reference to the embodiments illustrated in the drawings. It will be appreciated that upon installation, a structural member of the present invention may be orientated in any way such that, for example, the upper edge of the web may face downwardly toward the ground, or laterally.

In one embodiment of the invention (i) the region of contact between the first face of the web and the first surface of the first round flange is distal to the lower edge of the web, and (ii) the region of contact between the second face of the web and the second surface of the second round flange is distal to the lower edge of the web.

In one embodiment, the paired upper and lower flanges take load as they are proud of (or at least level with) the top of the web, this arrangement actually orientating the overall load forces into the web. Where there are upper and lower paired flanges, they may be reinforced by longitudinal lamination.

As it is the intrinsic mode of failure of such beams to laterally distort at the top whilst the bottom tries to stabilise such twisting forces it is the imparted lateral stability of present structural member that allows the beam to support its maximum shear loads in the Y axis before failure.

The round cross-sectional flanges, whether hollow or solid, bear loads more symmetrically in all directions than other shapes thereby transferring these loads to the web more evenly at the areas of lamination.

In timber especially, there are numerous waste by products, and very low value products of the forest industry and plywood industry that may be used economically and in a manner generally assisting in the conservation of timber resources. The present structural member may be fabricated from such waste products, and particularly the round flanges.

Where the round flange is timber, the deflection is far less when compared to a sapwood sawn timber or far more cost-effective than any expensive laminated lumber.

In the present structural member, there is an effective 'folding in' or 'gripping' of the forces applied to the web by the two round flanges, already prevented from rolling by way of the laminations when a load is applied.

Also, for perfect round timber, any downward loads in the Y axis will effectively and be transferred back to better support the bottom of the lamination area, by way of the circular separated growth layers/rings which are like a series of concentric pipes. Centrifugal forces are at their greatest and most effective at the outside layers to transfer back to these laminated areas. The same can be said for transference of lateral deforming forces at the bottom being transferred back to the top line of the longitudinal lamination. This is similar to metal pipe (rather than that of the solid amorphous metal rod). These side to side opposed forces by this invention by the two flanges either side reinforce the web and greatly resist its warping or twisting (as in the traditional I-Beams which whilst they have the side parts of their flanges made up of sawn timber or laminated lumber their resistance to forces in the X axis and therefore torsional forces is very ineffective as well as cost ineffective).

In the present structural members, adhesive surface areas and contacting face surface areas can be reduced due to the more effective circular reinforcing nature of this invention whereby the two flanges pinch back upon the web and support it upwards in the Y axis. If this was done by two rectangular/square flanges the load forces downwards in the Y axis would be simply cantilevered and far less reinforcing.

These circular shapes on opposite sides of the web allow for the use of weaker or lower cost webs because their points of lamination are further down and up the web for top and bottom areas respectively when compared to the two traditional sides of a flange for I-Beams and not at the tops and bottoms of the web but rather closer together according to the Y axis from top to bottom) and by reducing such effective height difference of the laminated surfaces of the web they resist these torsional forces much better than those critical to the characteristic failure of traditional I-Beams. They allow for thinner webs and webs of lesser height and therefore less material.

As will be clear form the above, timber is a preferred material from which at least the flanges of the present structural member may be fabricated. However, principles of structural engineering contemplates that other materials may also be used such as a solid material (including a polymer, a fibreglass, a metal such as steel and the like).

In one embodiment, one or more of the round flanges has/have a diameter of less than about 125 mm, or about 100 mm, or about 75 mm, or about 70 mm, or about 65 mm, or about 60 mm, or about 55 mm, or about 50 mm, or about 45 mm, or about 40 mm. In another embodiment, the flange(s) has/have a diameter of less than about 60 mm.

In some embodiments, a flange is a "peeler core". As is understood by the skilled person, a peeler core is a round pressure treated post. A peeler core has been turned in a milling machine to the point that substantially all the soft wood has been removed (for plywood manufacturing), leaving the hardwood core which is typically dense and inflexible. The milling process peels off the bark, cambium layer, sapwood, and even some of the heartwood to make veneer panels. This leaves no sapwood on the post.

The hardwood core of a peeler core does not absorb the pressure treatment and preservatives as well as the softwood resulting in an inferior post that will typically not last as long as a post with treated softwood on the exterior.

Applicant has discovered an economically and technically viable use for peeler cores in that the cores may be used in a structural member such as that disclosed herein. The use of multiple peeler cores (and even those with a diameter down to about 70, 60, 50 or 40 mm) can produce a member which is useful in construction and yet is highly cost-effective.

Peeler cores are essentially a waste product of forestry, having little value in the market. In one embodiment, the present invention is directed to structural members whereby all round flanges are peeler cores.

The round flanges may be so-called "true round sections", or "true rounds". Timber rounds are described in Section 6 of Australian Standard 1720, and are typically produced from softwood trees grown commercially as renewable forest plantation timber. These timbers are typically fast growing, easily harvested, and have a low natural defect rate.

Various species of timber are suitable to form the true rounds, particularly those types of species that tend to have a relatively constant diameter for a considerable portion of their length to minimise waste during the trimming and circularising processes. Plantation pine materials, such as slashpine or Carribaea hybrids, tend to form suitable true rounds. Other materials that might be considered include Douglas fir, and various eucalypt species.

True rounds are particularly strong since the natural strength of the timber fibres is not disrupted by sawing or other treatment. The integrity of the round is maintained, and the trimming process required to circularise the round does not greatly affect the overall strength of the round. The natural characteristics of timber are that the central core or pith of the round is relatively soft and has low structural strength. The periphery of the timber, on the other hand, is much harder and the timber fibres are able to carry a high tensile load. Also, this hard outer layer is more resistant to water absorption and attack by insects, and thus by keeping the outer circumference of the timber largely intact in the process of preparing a true round, the structural integrity of the timber is maintained The rounds in some forms of the invention do not strictly conform to Australian Standard 1720, and may be of a smaller diameter such that the Standard is not satisfied.

A segment of the round flange is typically removed along the flange length so as to provide a substantially planar surface for contacting the web face. The round flange may be machined or otherwise treated to remove a minor segment along the length of the round in order to provide a contact surface. The proportion of the flattened contact surface to the diameter of the round is selected to provide the structural member being manufactured with a suitably sized cross section. A suitable minor segment size for removal may be a segment with a depth of approximately 0.2 times the diameter of the round—i.e. for a 75 mm round a minor segment with a depth of approximately 15 mm is removed. The proportions may be altered depending on the particular structural application that may be required.

Figure 7:
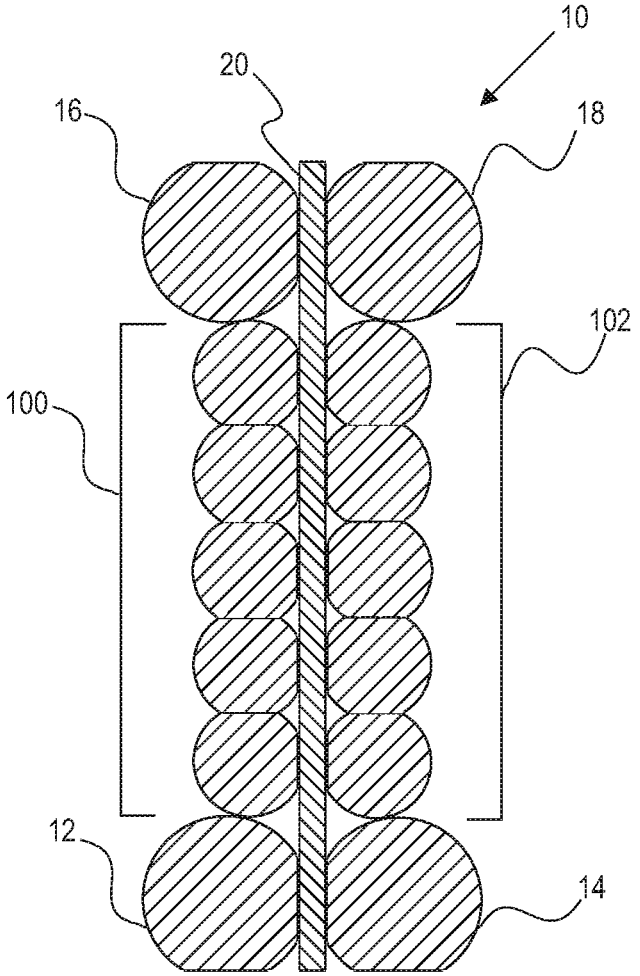
Figure 8:
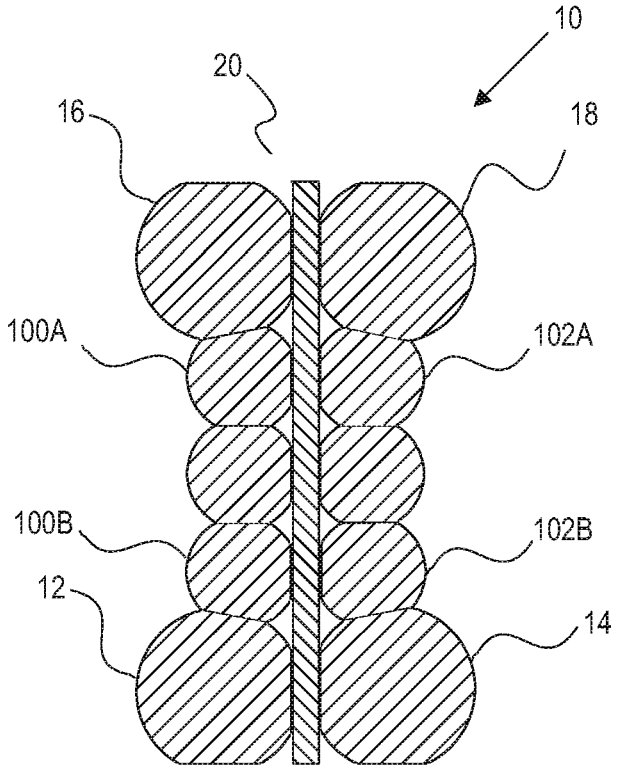
Figure 9:
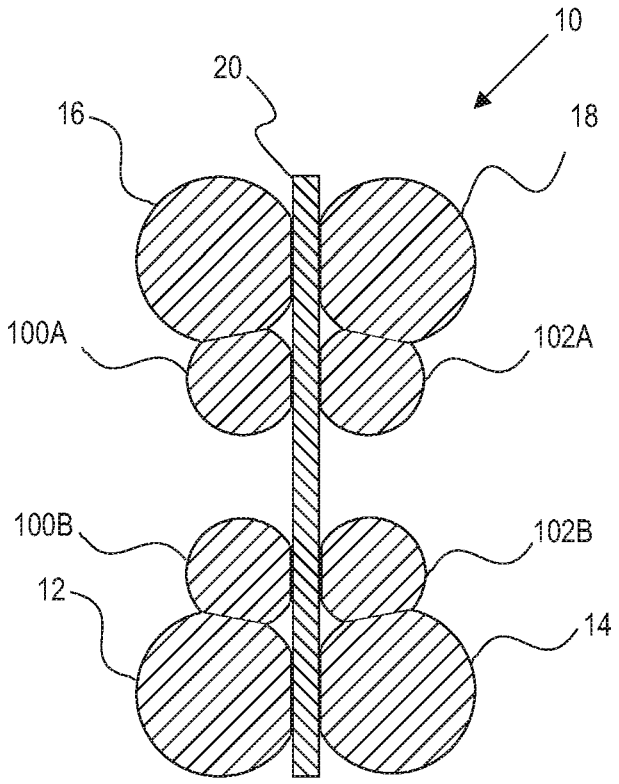
FIG. 9 is diagrammatic representation in end view of a structural member having multiple pairs of opposing flanges that do not form a continuum along the web, and leave an area of the web exposed.

A segment of the round flange may be removed along the flange length so as to provide a substantially planar cooperating surface for contacting an adjacent flange (as shown in FIGS. 7, 8 and 9).

Figure 5:
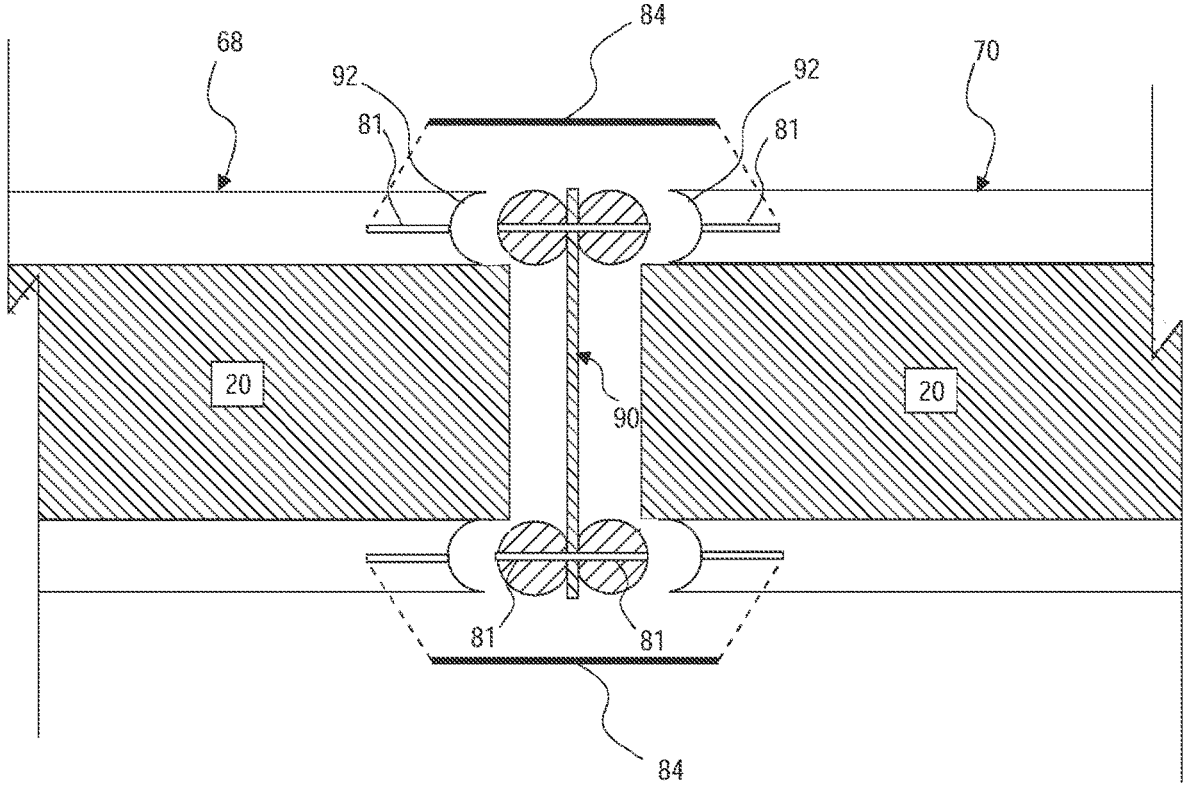
FIG. 5 is an exploded diagrammatic representation of the structural member shown in FIG. 1 (in end view) joined to two similar structural members (in lateral view).
Figure 6:
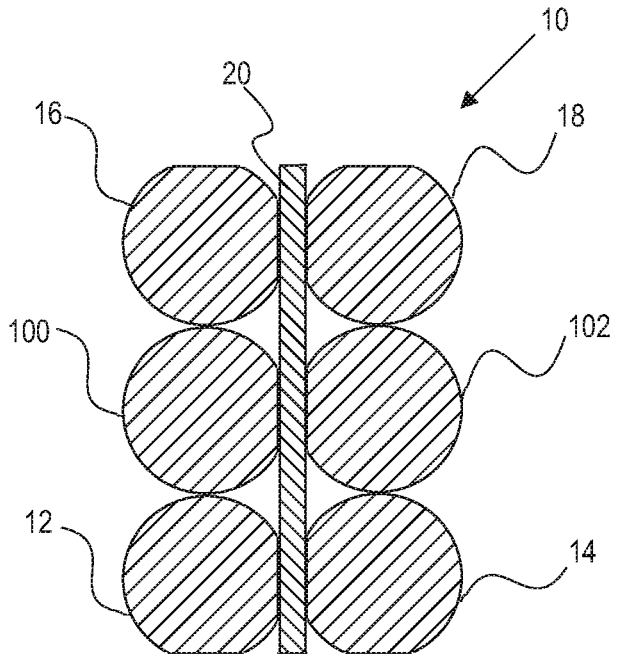
FIGS. 6, 7 and 8 are diagrammatic representations in end view of structural members having multiple pairs of opposing flanges forming a continuum along the web.

In other embodiments a segment of the round flange may be removed along the flange length so as to provide a substantially planar bearing surface (see for example the upwardly facing horizontal surfaces on flanges 16 and 18 in FIG. 6). In other embodiments a segment of the round flange may be removed along the flange length so as to provide a substantially planar mounting surface (see for example the downwardly facing horizontal surfaces on flanges 16 and 18 in FIG. 6). It will be understood that other embodiments of the present structural member (such as those shown in any one of FIGS. 1 through 5) may be similarly configured so as to provide a substantially planar mounting and/or bearing surface.

These horizontal planar surfaces may be configured to contact a building feature such as a concrete slab, a frame member, a bearer, a joist, a stump, a segment of flooring or similar.

Prior to joining the machined rounds to create the structural member, the rounds may be treated with a preservative to provide service life protection. Varying degrees of protection can be imparted dependent upon the intended application of the structural member. A suitable preservative may be provided by employing the process known as Ammoniacal Copper Quaternary (ACQ) which is Chromium and Arsenic free.

Hollow materials such as bamboo stalk, or a metal pipe may also be useful as the round flange. A segment of the hollow round flange may be removed as discussed above to provide a surface for contact with a web face.

In one embodiment of the structural member, the web is formed of a relatively high strength planar material such as timber, processed timber; chipboard, plywood, metal sheet, metal plate, fibre reinforced cement sheet, plastic, and fibre reinforced plastic material.

In one embodiment, the structural member comprises two sets of paired opposed round flanges in combination with a web (as shown in FIG. 1). As will be understood, this embodiment bears some similarity to a prior art I Beam. However, there is at least one important difference which confers surprising advantage. The flange components of the present invention do not bear on an edge of the web. Instead, the round flanges of the present structural member contact the web on the web faces, and transmit force in a manner very different to that of a prior art I Beam. As discussed above, the present structural members have an improved resistance to torsional forces.

Figure 2:
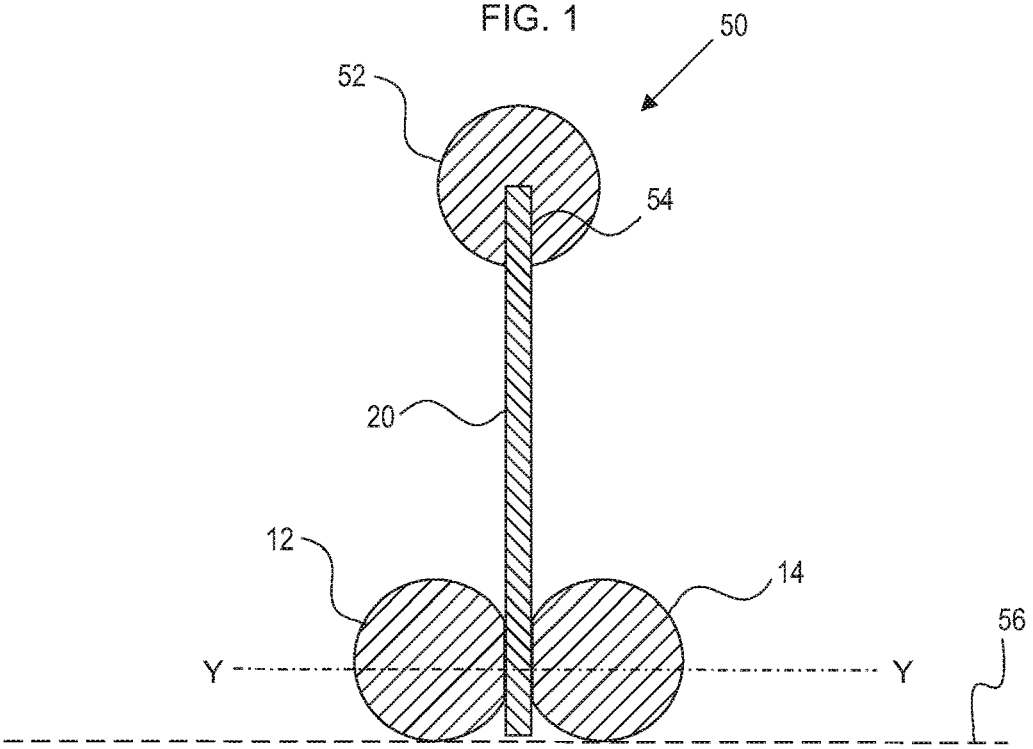
FIG. 2 is a diagrammatic representation in end view is an alternative structural member of the present invention.

An alternative embodiment is shown in FIG. 2 whereby a single slotted round flange is mounted on the upper edge of the web. This embodiment still has the opposed round flanges contacting the web faces, allowing for the novel transference of forces through the member. While this form of the invention is more susceptible to torsional deformation compared with that of FIG. 1, it is nevertheless a useful article in its own right.

The slot typically extends longitudinally along the length of the flange, the slot being dimensioned to receive the web, the web being bonded in the slot, and wherein the web extends to a depth of at least about 5%, 6%, 7%, 8%, 9%, 10%, 11%, 12%, 13%, 14%, 15%, 16%, 17%, 18% 19% or 20% of the diameter of the flange into which it is embedded. In one embodiment of the timber joist, the web extends to a depth of at least about 21%, 22%, 23%, 24%, 25%, 26%, 27%, 28%, 29% or 30% the diameter of the flange into which it is embedded. In another embodiment of the timber joist, the web extends to a depth of at least about 31%, 32%, 33%, 34%, 35%, 36%, 37%, 38%, 39%, 40%, 41%, 42%, 43%, 44%, 45%, 46%, 47%, 48%, 49%, 50%, 55%, 60%, 65%, 70%, 75%, 80%, 85%, 90% or 95% the diameter of the pole into which it is embedded. In one embodiment, the web extends along a radial line and to the axial centre of the flange. In one embodiment, the web completely bisects the flange into which it is embedded. In that embodiment, the slot has been further modified to completely remove the slot floor thereby bisecting the flange.

The flanges may be secured to the web by any means deemed suitable by the skilled person having the benefit of this specification. For example, the flanges and web may be assembled in a required configured and simply bound together by wrapping a material firmly about the outside of the structural member. Alternatively, an adhesive may be used at the regions of contact between the components of the structural member. As another alternative, fasteners extending through the components may be used to secure the overall structural member.

The skilled person will be capable of selecting an appropriate fastener type, and may choose from pins, dowels, rods, screws, bars, or bolts. In one embodiment, the fasteners are deformed reinforcement bars of the type typically used in the concrete construction industry.

The fasteners may be inserted by any method deemed appropriate by the skilled artisan, and may be manually rotated into the final position, or in rotated with the assistance of an electric drill or similar device.

Alternative fasteners include, for example, hot dipped galvanised deformed or Y-bar dowels, or any other dowel/rod/fastener with suitable strength properties for the requirements of the structural member and environmental conditions to which the structural member will be exposed. For example, and depending upon the proposed application of the structural member, fasteners of varying corrosion protection can be deployed.

The positions and angles of the boreholes may be selected to ensure that once fasteners have been secured in place sufficient bonding occurs to ensure true composite action of the structural member.

The diameters of the boreholes and the dimensions of the fasteners may be selected in accordance with the intended application of the structural member. The holes may be sized to allow the fasteners to fit with sufficient clearance as dictated by the performance properties of the adhesive bonding material being used. The diameter of the holes may be from about 0.5 mm to about 4 mm larger than the greatest diameter of the fastener to be inserted therein.

The skilled person understands that measurements used in the nomenclature of deformed bars may not properly reflect the true dimensions of the bar, and that independent measurements should be made before deciding a diameter for the receiving hole. For example, what is commonly termed a "16 mm" bar is typically 17.5 mm at the widest diameter, and so where a 1 mm gap is required between the fastener and the hole wall, a hole of 19.5 mm diameter is used.

In one embodiment the holes and fasteners are of a relatively small diameter. Fasteners equal to or less than about 12 mm or about 10 mm in diameter may be used. For example, an N10 deformed bar (Mesh and Bar Pty Ltd, Australia) may be used. Relatively small diameter holes require lesser amounts of glue (where used), thereby increasing the cost-effectiveness of the present beams.

When securing the fasteners in the holes a preformed annular centring ring may be used to ensure the fastener may be centrally located in the hole. The centring ring (described below) allows the adhesive to flow through the ring into the hole to ensure full encapsulation of the fastener by the adhesive. The adhesive is injected around the fastener from one end of the hole, the other end of the hole allowing air to escape during the injection process. This ensures uniform distribution of the adhesive around the dowel within the hole. The adhesive may be injected using, for example, a trigger cartridge gun or pneumatic cartridge gun. A washer (described below) may also be disposed inside the hole across the interface between two rounds to prevent glue from escaping at the interface.

Once the members have been located in a jig the fasteners are inserted into holes and glue injection takes place. The rounds and are held in place whilst the adhesive achieves initial curing. This typically occurs within 4 hours but is dependent upon a number of variables including temperature, moisture content of the timber and glue formulation. If a cambered structural member is required this can be achieved by applying the camber to the rounds and in the forming jig. Applying an initial set to the rounds while the adhesive cures will ensure that the pre-camber is maintained in the structural member.

The adhesive bonding material may, for example, comprise a two component epoxy material or in some applications a single phase epoxy may be used. Ideally the epoxy completely encases the fastener, thereby providing a barrier to corrosion of the fastener along its entire length. Specifically, a suitable adhesive is a structural epoxy resin such as waterproof thixotropic solvent free epoxy resin. The adhesive bonding material provides the additional benefit of providing corrosion protection to the embedded fasteners.

In one embodiment, fasteners are inserted so as to connect opposed flanges, by inserting through both flanges and also the region of web that contacts the flanges. Typically, the fastener is inserted radially through each flange. Generally, a borehole is first drilled with the fastener inserted into the borehole. An adhesive may be applied to the fastener/borehole so as to improve the strength of the fastening. In one embodiment, the holes are sized to allow sufficient clearance between their edges and the fasteners to allow each fastener to be encapsulated by the adhesive within the relevant hole. In another embodiment, the encapsulation of the fasteners by the adhesive prevents the fasteners from contacting the sides of the holes in which they are located. In another embodiment, the ends of the fasteners are provided with caps, the caps preventing exposure of the ends of the fasteners to the environment.

A fastener may extend orthogonally to the longitudinal axis of the structural member. In other embodiments a fastener may extend at an angle to the longitudinal axis. In further embodiments, the fasteners may extend alternately at an acute and obtuse angles when considered in plan view. The acute angle may be equal to or greater than about 20°, 25°, 30°, 35°, 40°, 45°, 50°, 55°, 60°, or 65°. The acute angle may be less than about 70°, 65°, 60°, 55°, 50°, 45°, 40°, 35°, 30°, or 25°. In one embodiment the acute angle is about 45°. The skilled person understands that the angles specified herein are not required to be precisely those cited numerically. Indeed, there is typically no requirement for great accuracy in the art with variations of 5% in these angles generally being tolerated. However, where required by engineering specifications to provide for a predetermined load bearing capacity, a lower tolerance may be provided for.

Typically the obtuse angle is calculated by the addition of 90° to the acute angle. In some embodiments, the obtuse angle is equal to or greater than about 110°, 115°, 120°, 125°, 130°, 135°, 140°, 145°, 150°, or 155°. The obtuse angle may be less than about 160°, 155°, 150°, 145°, 140°, 135°, 130°, 125°, 120°, or 115°. In one embodiment, the obtuse angle is about 135°.

Figure 4:
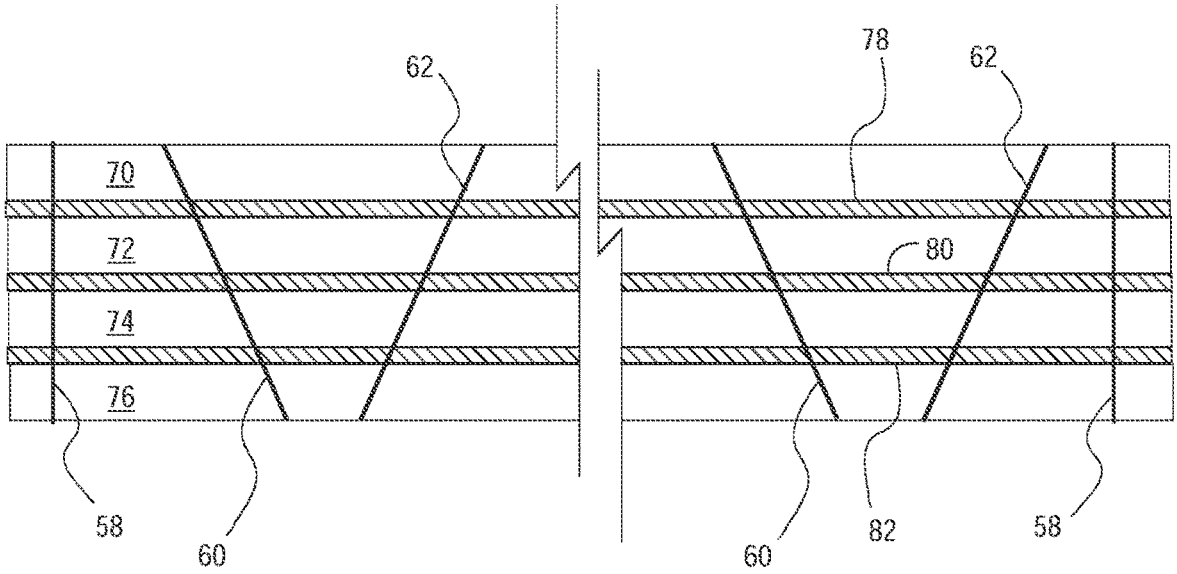
FIG. 4 is a diagrammatic representation in plan view of the structural member composed of a series of flanges interconnected by a series of webs.

In some embodiments (and particularly where multiple structural members are secured together (as shown in FIG. 4) steeper angles are generally preferred.

The fasteners may laced through the structural member. The number, type and angle of insertion of the fasteners will depend on the intended application of the structural member.

The fasteners may be inserted in a repeating V-pattern (see FIG. 4, for example, showing the V-pattern in plan view). In addition or alternatively, the fasteners may be inserted to provide a repeating V-pattern when viewed laterally. In some embodiments, the fasteners provide a trussing effect. The ability of the fasteners (in their diagonal configuration) to transfer imposed loads from the bearing surfaces to the outer connection nodes reduces the amount of stress borne by the round flanges alone.

Depending on the intended application of the structural member, either one or both ends of the rounds of the structural member may be provided with axial bores and/or radial cuts to facilitate connection of the structural member to another member or structure.

The axial bores allow for dowel type end grain connections to be made at each end of the structural member. The axial bores are machined into the end (or ends) of the rounds to a predetermined depth. Each bore is dimensioned to receive a steel dowel (or similar) as shown.

As per insertion of the fasteners as described above, the axial bore will generally be of slightly larger diameter than the dowel to allow an adhesive bonding material to be injected and fully surround the dowel, thereby ensuring a high strength bonded connection between the dowel and the rounds. The adhesive may be injected using, for example, a trigger cartridge gun or pneumatic cartridge gun.

To ensure that the dowel is centred within the bore, an annular preformed centring ring may be used. The centring ring (typically an "0" ring) may include a central aperture having a diameter substantially the same (or slightly larger) than the dowel to be used. The circumference of the centring ring is provided with a number of lugs which are sized/positioned to engage with the edges of the bore. In use, the centring rings are placed and affixed along the dowel with at least one centring ring for each member that the dowel will need to pass through.

The dowel is then inserted into the bore through the central aperture of the centring ring. The centring ring ensures the dowel is centrally located within the bore and allows adhesive to be injected into the bore between the edges of the bore and the lugs. The centring ring may be made from plastic, metal, or a composite of materials.

A washer may be used across the interface(s) between the structural member 100 and any other members it is attached to, thereby limiting leakage of glue into the joints between members. The washer may comprise an annulus that has a central aperture, the inner diameter of the annulus being substantially the same as the dowel, and the outer diameter of the annulus being substantially the same as a rebate that is bored axially aligned with the bore. The length of the washer can be between 2 and 10 mm, and the length of the rebate therefore needs to be at least sufficient to accommodate the washer, with the washer crossing from one member, across the interface between them, into another member. The inner surface of the annulus has a number of lugs which are sized and positioned to hold and centre the inserted dowel in the bore (or hole).

When connecting the structural member to another member or round (or when connecting the three rounds of the structural member together), the process generally entails drilling the required holes in the relevant members or rounds, inserting the dowel/fastener (either with or without using a centring ring), inserting the washers across the joints, and then injecting the glue from an exposed end of a hole through the members or rounds.

Alternatively, a dowel/fastener-washer combination can be inserted simultaneously. If required, the glue may be injected with the use of a bleeder hole. Once the glue has been injected, the dowel/fastener will be encapsulated by glue. The ends of the dowels/fasteners can be protected from coming into contact with the timber by using an end cap or dipping the ends of the dowel in a compound such as liquid rubber so as to create a cap with a diameter substantially that of the bore or slightly less.

With regard to the fasteners, the end cap may also serve to centre the fastener in the bore, in which case the centring devices as discussed above may not be required. The end caps also prevent the ends of the fasteners from being exposed to the environment and serve to smooth out/cushion the ends of the fasteners, thereby dealing with a potential breaking point.

In some embodiments, the fasteners may be disposed to ensure that no portion of a fastener extends outside the member. Many building standards have provisions for fire proofing timber components, including a requirement that metal fasteners (as good thermal conductors) are appropriately insulated from the environment. Thus, the fasteners may be disposed such that at least a certain minimum depth of wood (for example at least 20 mm) exists between the end of a fastener and the nearest edge of the member. Alternatively, plugs or end caps may achieve the same level of insulation.

In addition to allowing the securing the dowels, the axial bores may also remove the central (and usually weakest) part of the rounds. This, in turn, provides enhanced strength/structural integrity to the structural member as a whole.

Once the dowels are secured in the structural member their free ends can be used to connect the structural member to an additional member/structure. Load forces experienced by such a combined structure are then transmitted axially through the rounds of the structural member. This serves to add to the strength of the combined structure.

Further, by housing the connecting dowels within the rounds the dowels are largely protected and insulated from fire. Other known joining systems make use of connectors (e.g. dowels, pins, nails, bolts, plates etc) which are externally fitted. In the event of a fire, such externally fitted connectors have been found to transfer heat into the timber of the joist resulting in an undesirable increase in the destabilisation of joints. It is theorised this increase in destabilisation is caused by the connector becoming so hot that the timber in the hole is charred and shrinks away, thereby creating dynamic stresses in now moving members.

By providing internal dowel connectors this problem is avoided, and the fire rating of the structural member is dependent on the rounds. It is further noted that the rounds and used in the present invention are, in their own right, less combustible than sawn timber.

In use, it is envisaged that the free ends of the dowels will be inserted into a bore in the member/structure which is being secured to the structural member. A similar bonding arrangement to that described above is used to ensure that both ends of the dowel are properly anchored in their respective bores.

By providing for connection to/with the structural member by a pair of axial dowels twisting of the structural member as load is applied is prevented. If required, both ends of the structural member can be secured in this fashion Where the structural member is to be connected to a circular pole or the like, or a round flange of another structural member (as shown in FIG. 6), the ends of the rounds may further be provided with radial cuts. Although the term "radial" is used it will be appreciated that the cut need not be precisely circular and could have a more general scalloped or concave shape. The radius of curvature, or the shape, of the cut is selected to mirror the diameter of a circular pole or generally concave shape of another member to which the structural member may be connected. This provides for a neat and structurally sound connection with the circular pole or other member.

The radial cuts may be machined into the rounds using, for example, a customised large bore hole saw machine. Further, the angle of the axes of the radial cuts may be selected to allow for connection with another member at any orientation.

In a further aspect the present invention provides methods for producing the timber structural members described herein.

The timber structural members described may be used in any application for which they are deemed suitable by the skilled artisan. One particular application is as a composite joist formed from the structural member of this invention exhibit numerous benefits over traditional single member sections. For example, the structural member may provide the appropriate depth to width ratio required for use as a beam: the ratio is approximately 2 to 1, making it well suited as a bending member. The members are economically manufactured by taking advantage of low cost raw materials, waste material from felling and milling and also less expensive softwood species.

In some embodiments, the timber structural member may have a construction such that for maximum load bearing capacity the member must be disposed with one face directed toward a load vector, while the opposite face points away from the load vector. As an example, where the fasteners are arranged in a V-pattern, the timber structural member may be installed such that the "V" is upright. The centre of a beam is its weakest point, and where a 'V' is disposed toward the centre of a beam the asymmetry becomes particularly evident. At this point, strength is not compromised where the "V" is orientated upright, however if the beam is turned through 180 degrees (such that the "V" is inverted) there is a significant distance between the exit points of fasteners pins at the lower face of the beam (where the strain/deflection/tension is greatest) leading to a vulnerability in the beam. Accordingly, some embodiments of the invention comprise indicia indicating the preferred or required orientation of the timber structural member.

The applications for the structural member of the present invention are the same as that of any other beam or beam/column material, including typical domestic construction. The structural member is dimensionally suited to higher torsional applications and can effectively replace larger sawn sections in domestic construction and laminated veneer sections in commercial constructions.

The applications for the structural member include, by way of non-limiting example only, floor members such as bearers or joists, wall framing members such as lintels and heavy duty studs, roof framing members such as rafters or hanging/strutting beams, portal frame members such as columns, rafters or bottom chords, and beam/column members including piers and acoustic barrier posts.

Some embodiments of the present invention are well suited to shorter span applications, such as spans of around 3 metres or less. However, where longer spans are required, there exists the option of joining multiple members (in a lengthwise manner) to provide the required length. The multiple members may be joined in any manner deemed suitable by the skilled artisan, and may be mitred, dovetailed, finger-jointed, butt-ended or dowel pinned. A preferred form of dowel pinning is described in PCT/AU2009/001453.

The present structural members may also be useful as studs, which are generally of shorter length than a joist and of decreased thickness. Studs (and indeed structural members for any other applications) may be formed by rounds of mixed sizes, for example 70/60/70 mm or 80/70/80 mm.

As briefly discussed supra, the present structural members may be useful as joists. Such joists may be formed into modules of 2.4 m by 2.4 m to create a very strong modular flooring system where the outside or perimeter joists of a module co-operate with the adjacent and abutting edge of a joist in a similar module by cross pinning and laminating and through pinning and laminating. In this case, modules of 2.4 m by 2.4 m can abut all the way around to another module in an additive manner except for the outside of the shape which can also benefit by laminating a further joist to it. Effectively, this new cross pinned and laminated double member joist is capable of acting as a bearer when supported at every 2.4 m and by adding an extra joist this system is reduced by that 2.4 m length of more expensive (but stronger) bearer. A further advantage is that modules can be prefabricated and delivered to site with considerable cost and time savings Optimum beam depth to span ratios generally stay true for increasing element numbers in a beam and when that beam is used as a joist it can still produce the lowest beam mass per meter per unit of load carried. Such Joists may comprise 5×50 mm rounds to provide a joist of 215 mm H, or 6×50 mm rounds to provide a joist or 210 mm H, or even a 7×40 mm rounds to provide a joist of 180 mm H.

The skilled person understands that by performing a similar analysis on a range of conformations it will be possible to effectively optimise joists based upon resource availability and beam function.

In some embodiments, the multiple members are not physically joined, and simply abut each other in situ.

Embodiments comprising multiple members provide further economic and/or environmental advantages given that wood that may have ordinarily been discarded due to insufficient diameter and insufficient length may be utilised to produce a high value beam.

The various elements can also be joined to form a range of connections such as truss nodes (knee and ridge connections).

Because ply peeler cores are typically no longer than 2400 mm, the present extended span members are a very cost effective means of utilizing peeler core off-cuts, whilst lengthening the span. Global ply industries produce many smaller sizes as well (generally from 800 mm min with 300-400 mm increments up to 2600 mm) which commercially typically results in 2400 mm lengths. The present invention provides makes use of not only the immense global wastage of peeler cores, but also even the shorter lengths and off-cuts of this waste product.

Such extended span members allow the use of previously low value elements (such as peeler cores, and even relatively short peeler cores) which are waste products from the production of high value commercial plywood products. The ability to combine low value products into longer spans thereby providing higher value, longer span products is a significant advantage of these embodiments.

The present invention will now be more fully described by reference to the following preferred embodiments.

Preferred Embodiments of the Invention

Referring to FIG. 1 there is shown a preferred structural member 10 of the present invention having a first round flange 12, second round flange 14, third round flange 16, fourth round flange 18 and a web 20. Each round flange 12, 14, 16, 18 has a segment removed so as to create a contact surface 22 configured to abut a face of the web 20 in a flush manner.

The web 20 has an upper edge 24 and a lower edge 26. It will be noted that the flanges 16, 18 contact the web face distal to the upper edge 24; and also the flanges 12, 14 contact the web face distal to the lower edge 26. Thus, where a surface bears on the structural member 10 (two possible surfaces shown as 28, 30) the force is transferred from the surface to the flanges, and then to the web face (and not to a web edge 24 or 26).

It should be noted that forms of the invention where the surface 30 bears on the web edge 24 as well as the flanges 16 and 18 are included in the ambit of the present invention. Similarly, where the surface 28 bears on the web edge 26 as well as the flanges 12 and 14 are included in the ambit of the present invention. In these embodiments, at least some force is transferred through the round flanges and to the web faces thereby providing at least some advantage.

An alternative form of the structural member 50 is identical at the lower region as that of FIG. 1, having a first flange 12, a second flange 14, and a web 20. In this embodiment, the upper region comprises a single round 52 having a radial slot 54 configured to accept a round flange 52 having no segment removed therefrom. It will be noted that the where a surface bears on the structural member 10 (one possible surfaces shown as 56), force is transferred through the round flanges to the web faces thereby providing advantage.

Figure 3:
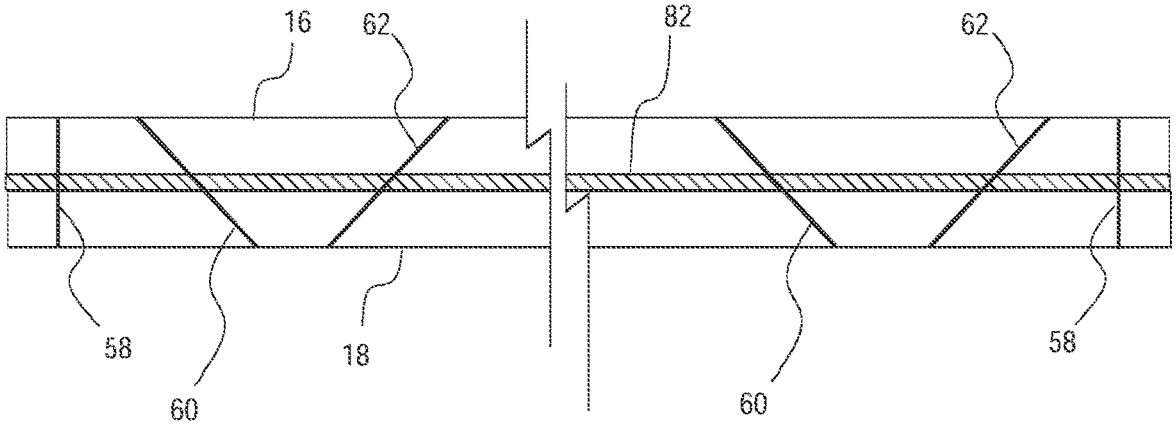
FIG. 3 is a diagrammatic representation in plan view of the structural member as shown in FIG. 1, and showing the position of fasteners which extend through the flanges and web.

Reference is now made to FIG. 3 which is a plan view of the structural member shown in FIG. 1. This plan view shows the orientation of fasteners inserted through the flanges 16 and 18 and also the web 82. There is shown a first type of fastener 58 which is inserted orthogonally the longitudinal axis of the structural member 10, a second type of fastener 60 is inserted at an acute angle to the longitudinal axis of the structural member, a third type of fastener 62 is inserted at an obtuse angle to the longitudinal axis of the structural member. All fasteners are coplanar, and located along the line "X" shown in FIG. 1.

Additionally, fasteners are inserted through the flanges 12 and 14 (not shown in FIG. 3, but underlie flanges 16 and 18 respectively) and through the web 82 along the line "Y" shown in FIG. 1.

Thus, two layers of fasteners are provided (at "X" and "Y"), each layer having (i) fasteners in a repeating V-shaped arrangement (formed by fasteners 60 and 62) and also (ii) fasteners disposed directly across the structural member 10.

FIG. 4 shows an embodiment (in plan view) similar to that of FIG. 3 but with additional round flanges 70, 72; and webs 78 and 80. Such a structural member has greater strength than that shown at FIG. 3 given the greater number of round flanges. It will be noted that the angles made by the fasteners 58, 60, and 62 are steeper than that for the embodiment of FIG. 3.

FIG. 5 shows means for joining three structural members of the present invention. The two structural members 68, 70 of the type shown in FIG. 1 are shown in lateral view. The flanges of structural members 68, 70 have boreholes 81 sized so as to accept dowels 84, and also scalloped cuts 92. Also shown is a third structural member 90 of the type shown in FIG. 1 is shown in end view. The structural member 90 also has boreholes 81 sized so as to accept dowels 84. Upon assembly, a glue is inserted into the borehole 81 before insertion of the dowels 84. The members 68 and 70 are urged toward the member 90 such that the scalloped cuts 92 contact the external surfaces of the round flanges of the structural member 90.

It is contemplated that the present structural members may have at least 6, 8, 10, 12, 14, 16, 18 or 20 flanges.

FIG. 6 shows a form of the invention having the addition of two further opposed flanges 100, 102 thereby providing a continuum of flanges along the web 20. In this embodiment, all flanges are identically dimensioned with adjacent flanges (such as 16 and 100) making contact with each other. It is proposed that such an arrangement provides higher resilience to deformation. Bearing surfaces 17 and mounting surfaces 19 are also provided by way of removal of a minor segment of the flange on upper and lower surfaces respectively.

As a variation to the general scheme proposed in FIG. 6, the flanges 100 and 102 may be of smaller diameter than flanges 12, 14, 16, 18 and/or have larger chamfers than flanges 12, 14, 16, 18 such that an I-shape is retained for the overall structural member.

A further variation is shown in FIG. 7 whereby multiple smaller intermediate flanges 100, 102 are disposed between the main flanges 12, 14,16, 18 to provide an overall I-shaped structure. Each of the smaller diameter flanges 100, 102 have one or two chamfers to provide cooperative surface for contact with an adjacent smaller diameter flange. A development of this embodiment is shown FIG. 8 whereby each of the larger diameter flanges 12, 14, 16, 18, is chamfered to provide a cooperative contact surface with an adjacent smaller diameter flange 1008, 102B, 100A and 102A respectively. It will be noted that the line of contact between the flanges 16, 100A is angled upwardly toward the web 20, as is the line of contact between the flanges 18, 102A. The line of contact between the flanges 12, 100B is angled downwardly toward the web 20, as is the line of contact between the flanges 18, 102A. The angled lines of contact are the result of juxtaposing flanges of differing diameter. Where the flanges are equal in diameter, the line of contact will be orthogonal to the plane of the web 20. Where the flanges 12, 14, 16, 18 are larger than the flanges 100B, 102B, 100A, 102A then the lines of contact between adjacent flanges will be in the reverse direction to that shown in FIG. 8.

The embodiment of FIG. 9 demonstrates a version of the structural member whereby a region of the web remains exposed.

In the description provided herein, numerous specific details are set forth. However, it is understood that embodiments of the invention may be practiced without these specific details. In other instances, well-known methods, structures and techniques have not been shown in detail in order not to obscure an understanding of this description.

In the following claims, any of the claimed embodiments can be used in any combination.

The invention claimed is:

1. A structural member for use as a load bearing member in building construction as a floor support member, a wall framing member, a roof framing member or a portal frame member, the structural member comprising:

a first flange having a substantially circular cross-sectional shape and a portion removed to form a first contact surface extending longitudinally along the length thereof, a second flange opposing and substantially parallel to the first flange, the second flange having a substantially circular cross-sectional shape and a portion removed to form a second contact surface extending longitudinally along the length thereof and opposed to the first contact surface, an elongate web disposed between the first and second flange, the web having:

a first face configured to contact the first contact surface, a second face configured to contact the second contact surface, an upper edge, and a lower edge, and a third flange having a substantially circular cross-sectional shape and a longitudinally extending slot formed therein, the slot being dimensioned so as to receive a region about upper edge of the web, wherein the first flange, the second flange and the elongate web are secured together to form a structurally integral unit in which at least part of the first face of the web is in contact with at least part of the first contact surface of the first flange, and at least part of the second face of the web is in contact with at least part of the second contact surface of the second flange;

wherein the uppermost points of the first and second flanges are substantially level, and the upper edge of the web extends beyond the uppermost points of the first and second flanges.

2. The structural member of claim 1 wherein (i) the region of contact between the first face of the web and the first contact surface of the first flange is distal to the lower edge of the web, and (ii) the region of contact between the second face of the web and the second contact surface of the second flange is distal to the lower edge of the web.

3. The structural member of claim 1 wherein each of the first contact surface, second contact surface, first face and second face are substantially planar.

4. The structural member of claim 1 wherein the diameter of the first flange is substantially the same as that of the second flange.

5. The structural member of claim 1 wherein the lowermost points of the first and second flanges are substantially level.

6. The structural member of claim 5 wherein the lower edge of the web does not extend beyond the lowermost points of the first and second flanges.

7. The structural member of claim 1 wherein the slot extends substantially radially into the third flange.

8. The structural member of claim 1 wherein the first, second and third flanges are substantially parallel.

9. The structural member of claim 1 wherein at least one flange is a timber pole or a timber round or a peeler core.

10. The structural member of claim 1 having a cross-sectional profile which is substantially symmetrical.

11. A structural member for use as a load bearing member in building construction as a floor support member, a wall framing member, a roof framing member or a portal frame member, the structural member comprising:

a first flange having a substantially circular cross-sectional shape and a portion removed to form a first contact surface extending longitudinally along the length thereof, a second flange opposing and substantially parallel to the first flange, the second flange having a substantially circular cross-sectional shape and a portion removed to form a second contact surface extending longitudinally along the length thereof and opposed to the first contact surface, an elongate web disposed between the first and second flange, the web having:

a first face configured to contact the first contact surface, a second face configured to contact the second contact surface, an upper edge, and a lower edge, a third flange having a substantially circular cross-sectional shape and a third surface extending longitudinally along the length thereof, a fourth flange substantially parallel to the third flange, the fourth flange having a substantially circular cross-sectional shape and a fourth contact surface extending longitudinally along the length thereof, and one or more fasteners extending in sequence through (i) the first flange, the web, and the second flange, and/or (ii) the third flange, the web and the fourth flange, wherein the first flange, the second flange and the elongate web are secured together to form a structurally integral unit in which at least part of the first face of the web is in contact with at least part of the first contact surface of the first flange, and at least part of the second face of the web is in contact with at least part of the second contact surface of the second flange, at least part of the first face of the web is in contact with at least part of the third surface of the third flange, and at least part of the second face of the web is in contact with at least part of the fourth contact surface of the fourth flange;

wherein the uppermost points of the first and second flanges are substantially level, and the upper edge of the web extends beyond the uppermost points of the first and second flanges.

12. The structural member of claim 11 wherein, in plan view, one of the one or more fasteners extends substantially orthogonal to the longitudinal axis of the web.

13. The structural member of claim 11 comprising two or more fasteners wherein, in plan view, one of the fasteners extends at an acute angle and the other of the fasteners extends at an obtuse angle to the longitudinal axis of the web.

14. The structural member of claim 11 comprising, in sequence, a first fastener extending, in plan view, substantially orthogonal to the longitudinal axis of the web, a second fastener extending, in plan view, at an acute angle to the longitudinal axis of the web, a third fastener extending, in plan view, at an obtuse angle to the longitudinal axis of the web, and a fourth fastener extending, in plan view, substantially orthogonal to the longitudinal axis of the web.

* * * * *